United States Patent [19]

Brinkmann et al.

[11] Patent Number: 4,721,182

[45] Date of Patent: Jan. 26, 1988

[54] PERSONNEL SAFETY DEVICE FOR AN UNDERGROUND DUCT PARTICULARLY A SEWER PIPE

[75] Inventors: Arnfried Brinkmann; Udo Heuser; Ernst F. Lehners, all of Essen, Fed. Rep. of Germany

[73] Assignee: Fahrleitungsbau Gesellschaft mit beschrankter Haftung, Essen, Fed. Rep. of Germany

[21] Appl. No.: 32,336

[22] Filed: Mar. 30, 1987

[30] Foreign Application Priority Data

Apr. 23, 1986 [DE] Fed. Rep. of Germany ..... 3613710

[51] Int. Cl.[4] ..... A62B 35/00

[52] U.S. Cl. ..... 182/3; 182/36; 272/70

[58] Field of Search ..... 182/3, 4, 5, 6, 7, 8, 182/36, 192, 193, 82; 272/70 A

[56] References Cited

U.S. PATENT DOCUMENTS

| | | | |
|---|---|---|---|
| 2,478,004 | 8/1949 | Newell | 182/36 |
| 2,871,915 | 2/1959 | Hogan | 182/3 |
| 3,217,833 | 11/1965 | Smith | 182/3 |
| 3,780,663 | 12/1973 | Pettit | 272/70 A |
| 3,860,089 | 1/1975 | Huggett | 182/4 |
| 4,606,430 | 8/1986 | Roby | 182/3 |
| 4,607,724 | 8/1986 | Hillberg | 182/3 |

OTHER PUBLICATIONS

"Arbeit and Sicherheit", Jan. 1985, p. 4.

*Primary Examiner*—Reinaldo P. Machado

[57] ABSTRACT

The safety device for a person in an underground duct, tunnel or the like, particularly for a person in a sewer pipe, comprises a guide rail attached by a plurality of spaced fasteners to the roof of the duct or tunnel and a traveling body movable on and along the guide rail which is attached with a safety tether to a safety belt worn by the person. The traveling body is a hingedly or pivotally openable and closable end piece device located at or near one end of a safety rod which is provided with a retaining eye for the safety tether and with an end piece handle at its other end.

14 Claims, 6 Drawing Figures

PERSONNEL SAFETY DEVICE FOR AN UNDERGROUND DUCT PARTICULARLY A SEWER PIPE

FIELD OF THE INVENTION

Our present invention relates to a safety device for a preson in an underground duct, tunnel or the like and, more particularly, to a safety or tethering device for a worker in a sewer pipe.

BACKGROUND OF THE INVENTION

A safety device for a person in an underground duct, tunnel or the like, particularly for a person in a sewer pipe, is known in the form of a guide rail attached by spacers to the roof of the duct or tunnel, and a traveling body movable on and along the guide rail which is attached by a safety tether to a safety belt or harness worn by the person.

This safety device has been metnioned in the January 1985 issue of the periodical "Arbeit und Sicherheit" (Work and Safety), page 4. However it has not been constructed for practical usage.

A great need for such a safety device exists particularly in regard to sewer pipes, especially collector sewers.

It is frequently reported that a person has slipped on the smooth surface of a sewer pipe and has floated away in an unconscious state with the sewage. Help has usually arrived too late. Our invention provides a remedy for this problem.

OBJECTS OF THE INVENTION

It is an object of our invention to provide an improved safety device for a person in an underground duct, tunnel or the like, particularly in a sewer pipe which will obviate these drawbacks.

It is also an object of our invention to provide an improved safety device for a person in an underground duct, tunnel of the like, particularly in a sewer pipe, which has a simple structure but nevertheless functions reliably and without endangering the user.

SUMMARY OF THE INVENTION

These objects and others which will become more readily apparent hereinafter are attained in accordance with our invention in a safety device for a person in an underground duct, tunnel or the like, particularly for a person in a sewer pipe, comprising a guide rail spacedly attached by a plurality of spaced fasteners (spacers) to the roof of the duct or tunnel and a traveling body movable on and along the guide rail which is attached with a safety tether to a safety belt or harness worn by the person.

According to our invention the traveling body is a hingedly or pivotally openable and closable end piece located at or near one end of a safety rod which is provided with a retaining eye for the safety tether and with an end piece actuating handle at its other end. The end piece can comprise a pair of cheeks which can be spread apart to release the rail and which can be brought together to embrace the rail.

Our invention is based on the consideration that the direct attachment of the safety tether to the guide rail in the underground duct is not practical because the guide rail is generally positioned too high for the attachment to be readily released by the user.

Hence in the safety device of our invention the retaining eye for the tether is connected to the guide rail through the safety rod which can be easily manipulated. The safety rod can be actuated to couple or decouple the end piece to or from the rail at any arbitrarily chosen position.

A hingedly or pivotally openable and closable end piece is provided for this purpose on one end of the safety rod. The person being protected pulls this end piece with the safety rod by the connected safety tether in the desired direction behind him after the traveling body and/or the end piece is coupled to the guide rail.

The guide rail advantageously can have a circular transverse cross section and the end piece engages and surrounds the guide rail with radial and pivotal play. This radial play makes sliding the traveling body on the guide rail easy while the pivotal play allows the safety rod to pivot on a pivot axis parallel to the guide rail so that the end piece does not strike against the spaced fasteners with which the guide rail is attached on the roof of the duct or tunnel. For this reason the end piece when closed can encompass the guide rail over an angle of 270° to 330°, advantageously 300°, of its circumference.

Advantageously in one embodiment the end piece comprises two individual end pieces pivotally or hingedly connected with each other, of which one end piece is rigidly attached to or near one of an upper member connected with the end piece actuating handle of the safety rod and the other end is attached to a pipe which surrounds the upper member. This embodiment is simple and functions reliably.

To allow the simplest possible sliding of the traveling body and/or the end piece on the guide rail, the end piece can be pivotally connected to the safety rod to pivot about a pivot axis perpendicular to the guide rail. For this purpose the safety rod is advantageously provided with a pivot joint with a pivot axis perpendicular to the guide rail in the vicinity of the end piece which is blocked when the end piece is open.

The blocking of the pivot joint facilitates the coupling and uncoupling of the end piece to and/or from the guide rail.

Advantageously this pivot joint is automatically blockable and releasable on operation of the end piece actuating handle.

In the above described embodiment in which the safety rod includes an upper member and a pipe surrounding it, this is advantageously accomplished by forming the upper member with the pivot joint and the pipe at the associated end being foreshortened so that the pivot joint is released with the end piece closed.

For simple and reliable operation of the end piece a coulisse or slide guide is advantageously associated with the end piece actuating handle in the pipe of the safety rod. It is understood that the connection of the end piece actuating handle to the upper member is correspondinly arranged, possibly for example by an interior rod attached rigidly to the end piece actuating handle.

The end piece actuating handle should be securable with the end piece closed to avoid an unintentional release of the end piece from the guide rail.

So that the safety device can be adjusted to fit people of different sizes or different duct or tunnel heights the retaining eye should be provided on an adjustably movable and securable retaining body on the safety rod.

The safety rod can be of an adjustable length for the same purpose. Further the end piece can be provided with a brake which is operable if the person using the safety device falls as a further improvement of the reliability and safety of the end piece.

BRIEF DESCRIPTION OF THE DRAWING

The above and other objects, features and advantages of our invention will become more readily apparent from the following description, reference being made to the accompanying highly diagrammatic drawing in which.

SPECIFIC DESCRIPTION

Figure 1:
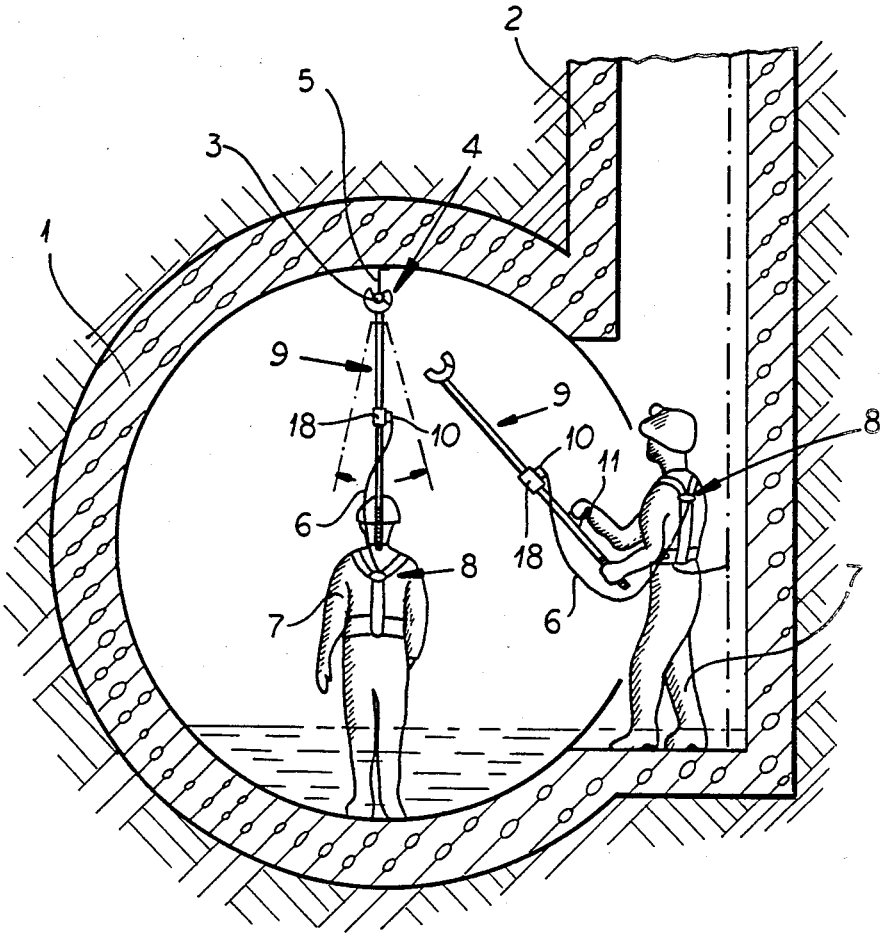
FIG. 1 is a transverse cross sectional view through a duct or pipe with a safety device according to our invention.

The safety device shown in the drawing is designed for persons who must move or work in an underground duct, tunnel or the like 1, particularly in a sewer pipe, e.g. to inspect the condition of the pipe. In the example illustrated, sewer conduit or pipe has an access shaft 2.

The safety device basically comprises a guide rail 3 and a traveling body 4. The guide rail 3 is suspended by spaced fasteners 5 to the roof of the duct, tunnel or the like 1 in segments following each other in succession and at a certain distance below the roof.

The traveling body 4 is movable on and along the guide rail 3 and is attached by a safety tether 6 to a safety belt or harness 8 worn by the person 7.

Figure 3:
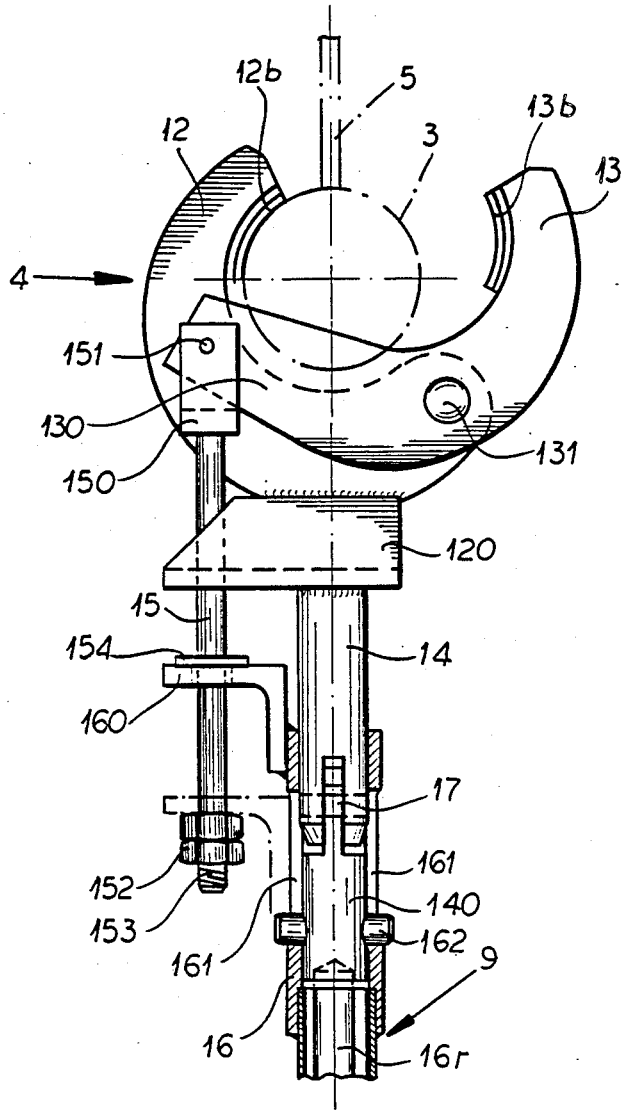
FIG. 3 is a partially cutaway front elevational view of a part of the safety device according to FIGS. 1 and 2, drawn to a larger scale.

As is particularly apparent from FIGS. 1 and 3 the traveling body 4 is a hingedly or pivotally openable and closable end piece 12,13 at one end of a safety rod 9 which is provided with a retaining eye 10 for the safety tether 6 and with an end piece actuating handle 11 near its other end.

While the segment 12, which has a cheek plate **12*b* affixed at its end, subtends, part of the arc of the circular-section rail 3 and is fixed to the end of the rod (as will be described, the other segment 13 is pivotally mounted at 131 to the other end of the fixed segment 12 and is extended into a lever arm 130. The latter is articulated to a fork 150 at 151. The fork 150 is provided at the end of the rod 15 which is guided in a bracket 160 welded to the upper end of the tube section 16. The latter is provided with a pair of slots 161 in which a pin 162 is received. The pin 162 is carried by the upper pivot stub 140 which is pivotally connected to a rod section 14 by a pivot 17 which has its axis perpendicular to the axis of the rail 3**.

A lost-motion mechanism is provided between nuts 152, adjustable along the threaded end of rod 15, and the bracket. Thus, when the rod **16*r* is thrust upwardly by the handle 11 in a manner to be described below, the stub 140 attached to this rod and the section 14 pivotally connected at 17 therewith are moved upwardly until the pivot emerges from the sleeve formed by the tube section 16 and the parts 14 and 140 can pivot relative to one another. The upward movement of the end piece continues to bring the nuts 152 into engagement with the bracket 160, thereby causing the segment 13 to pivot in the counterclockwise sense (FIG. 3**) to close the end piece.

To open the end piece, the handle 11 is drawn downwardly relative to the tube section 16, thereby bringing the stop collar 154 on the rod 15 against the bracket 160 until the segment 13 swings open, and of course sliding the pipe section 16 over the pivot 17 to prevent articulation of the end piece on the rod 9. The rod 15 is guided in a head 120 of the end piece which is affixed to rod section 14.

One sees particularly from FIG. 3 that the end piece 12,13 surrounds or engages the guide rail 3, which has a circular transverse cross section, with radial and pivotal play. Correspondingly the end pieces 12 and 13 are sector shaped. They encompass the guide rail 3 for about an angle of 270° to 330°, advantageously 330°, of its circumference. The end piece 12,13 comprises in particular two individual end pieces 12 and 13 pivotally or hingedly attached to each other. One individual end piece 12 is attached rigidly to one end of an upper member 14 of the safety rod 9. This upper member 14 is connected with the end piece actuating handle 11.

The other end piece 13 is connected with a pipe 16 of the safety rod 9 surrounding the upper member 14 by an operating lever arm 130 and an operating rod 15.

Thus the safety rod 9 has a pivot joint 17 with pivot axis perpendicular to the guide rail 3 blocked in the open end piece arrangement 12,13. This pivot is automatically blockable and releasable on operation of the end piece actuating handle 11 since the upper member 14 having the pivot 17 and the pipe 16 is foreshortened so that the pivot 17 is released when the end piece 12,13 closes.

The end piece actuating handle 11 is associated with a coulisse guide **11*c* in the pipe 16 of the safety rod 9. In this coulisse guide 11*c* the end piece actuating handle 11 is securable on closing the end piece 12,13 as shown in FIG. 4**.

Figure 4:
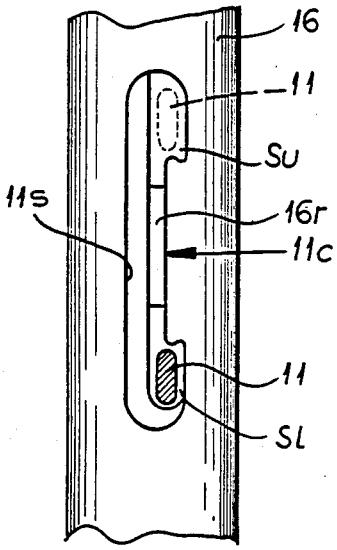
FIG. 4 is a detail view of another part of the safety device, also broken away.

The slidable interior rod **16*r* rigidly attached to the end piece actuating handle 11 can be slid between two positions one shown with solid lines the other shown with dashed lines in FIG. 4 (and FIG. 3). The handle 11 can be held fixed in slots Su and Sl of the handle slot 11*s* to hold the rod 16*r*** in one position or the other.

Figure 2:
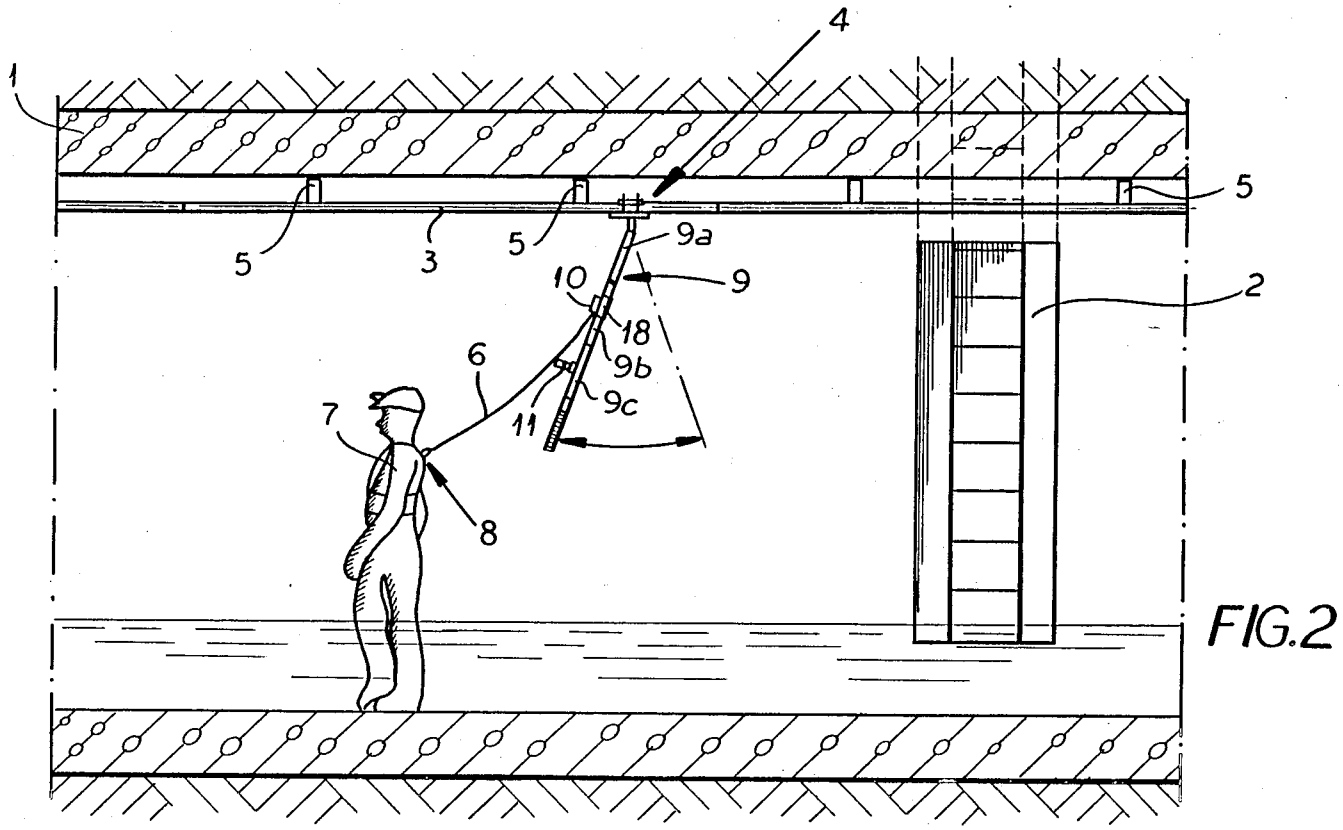
FIG. 2 is a longitudinal cross sectional view through the apparatus of FIG. 1.
Figure 5:
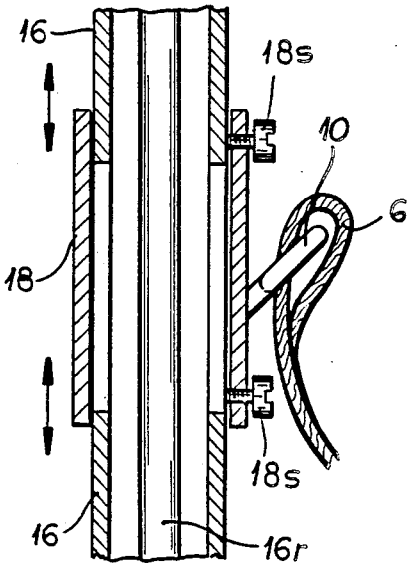
FIG. 5 is section showing another detail of the safety device according to FIGS. 1 and 2.

The retaining eye 10 is provided on a retaining body 18 shown in FIG. 5 which is movable or adjustable on the safety rod 9 to fit the height involved. It can be secured in any one place on the safety rod 9 with setscrews **18*s*. The tether 6 which in this example is a rope can be tied in the eye 10 of the retaining body 18 which is slidable on the safety rod 9 when the set screw 18*s* are not secured. Also the safety rod 9 can be variable in length and formed from a plurality of telescoping segments 9*a*, 9*b* and 9*c* as shown most diagrammatically in FIG. 2**.

The end piece 12, 13 can have a brake which is releasable by a fall of the person tethered.

Figure 6:
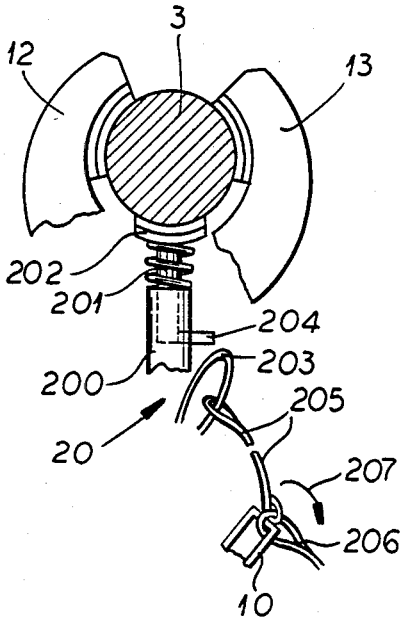
FIG. 6 is a fragmentary section illustrating a feature of the invention.

The brake is represented at 20 in FIG. 6. Here a brake guide 200 can be fixed to the head of the end piece and can receive a rod 201 carrying a brakeshoe 202. The brakeshoe is biased against the rail 3 by a spring 201. Normally the brakeshoe 202 is held out of engagement with the rail by a loop 203 of a cable affixed to the rod 9 at its opposite end (not shown), the loop engaging a finger 204 of the rod 201 projecting laterally through a slot of the guide 200. The loop 203, in turn, is tied by a cable 205 to the loop 206 of the tether engaged in eye 10. Hence, in normal operation the aforementioned radial play is provided between the end piece and the rail 3 in spite of the closure of the segments 12 and 13 therearound, so that the end piece can move along the rail, drawn by the user. Should the user slip, however, the full weight of the user applied to the tether will cause the eye 10 to deflect in the downward direction (arrow 207) and place tension on the cable 205 to pull the loop from the finger 204 and release the rod 201. The brakeshoe is immediately pressed against the rail, eliminating the radial play and preventing the end piece from sliding along the rail. Even if the user is unconscious, therefore, he cannot be swept along by the sewage.

The person climbing down through the access shaft 2 into the duct or tunnel 1 attaches his safety tether 6 to the retaining eye 10 and presses the safety rod 9 against the guide rail 3 with the end piece 12,13 opened. After releasing the end piece actuating handle 11 the end piece 12,13 is closed by longitudinal sliding of the upper member 14 relative to the pipe 16 of the safety rod 9. The safety rod 9 suspended from the guide rail 3 can now swing on all sides about 30°. As is apparent for FIG. 2 the person can now walk through the duct or tunnel 1 while he pulls the end piece 12,.13 with the safety rod 9 behind him. In case of an eventual fall the person who might otherwise have been rendered unconscious can no longer float away in the contents of the sewer pipe since that is prevented by the safety device.

We claim:

1. In a safety device for a person in an underground duct, comprising a guide rail spacedly attached by a plurality of spaced fasteners to a roof of said duct and a traveling body movable on and along said guide rail which is connected with a safety tether to a safety belt worn by said person, the improvement wherein said traveling body comprises:

a safety rod;

a pivotally openable and closable end piece located at one end of said safety rod;

a retaining eye for said safety tether on said rod; and an end piece actuating handle at the other end of said safety rod.

2. The improvement according to claim 1 wherein said guide rail has a circular transverse cross section and said end piece when closed surrounds and engages said guide rail with radial and pivotal play.

3. The improvement according to claim 2 wherein said end piece encompasses said guide rail over an angle of 270° to 330° of the circumference of said guide rail.

4. The improvement according to claim 3 wherein said angle is 300°.

5. The improvement according to claim 1 wherein said openable and closable end piece comprises two individual elements pivotally connected to each other, one of said elements being rigidly attached to one end of an upper member of said safety rod connected with said end piece actuating handle, the other of said elements being connected with a pipe surrounding said upper member by an operating lever arm and an operating rod.

6. The improvement according to claim 5 wherein said safety rod has a pivot joint with a pivot axis perpendicular to said guide rail blocked with said end piece open.

7. The improvement according to claim 6 wherein said pivot joint is automatically blocked and released on operation of said end piece actuating handle.

8. The improvement according to claim 7 wherein said upper member has said pivot joint and the appropriate associated end of said pipe is foreshortened so that said pivot joint is released when said end piece closes.

9. The improvement according to claim 5 wherein a coulisse guide is arranged for said end piece actuating handle in said pipe of said safety rod.

10. The improvement according to claim 1 further comprising means for securing said actuating handle when said end piece is closed.

11. The improvement according to claim 1 wherein said retaining eye is provided on an adjustably movable retaining body on said safety rod.

12. The improvement according to claim 1 wherein said safety rod is of an adjustable length.

13. The improvement according to claim 1 wherein said end piece is provided with a brake operable by a fall of said person.

14. A safety device for a person in an underground duct, tunnel or the like, particularly for said person in a sewer pipe, comprising:

a guide rail attached by a plurality of spaced fasteners to the roof of said duct;

a safety belt worn by said person;

a safety tether attached to said safety belt;

a traveling body movable on and along said guide rail comprising an openable and closable end piece at one end of a variable length safety rod which is provided with a retaining eye mounted on an adjustably movable retaining body on said safety rod for attachment of said safety tether and with an end piece actuating handle at the other end of said safety rod, said end piece encompassing said guide rail with radial and pivotal play over an angle of 270° to 330° of the circumference of said guide rail when closed and comprising two individual end pieces pivotally or hingedly connected to each other, of which one is rigidly attached to one end of an upper member of said safety rod connected with said end piece actuating handle and the other one of which is connected with a pipe surrounding said upper member by an operating lever arm and an operating rod; and a pivot joint in said safety rod adjacent said end piece with a pivot axis perpendicular to said guide rail blocked which is automatically blockable and/or releasable on operation of said end piece actuating handle.

* * * * *